US006921450B2

(12) United States Patent
Stein et al.

(10) Patent No.: US 6,921,450 B2
(45) Date of Patent: Jul. 26, 2005

(54) SOFT CONTACT ROLL FOR A SINGLE FACER

(75) Inventors: Kevin S. Stein, Phillips, WI (US); Dennis L. Lemke, Phillips, WI (US)

(73) Assignee: Marquip, LLC, Phillips, WI (US)

( * ) Notice: Subject to any disclaimer, the term of this patent is extended or adjusted under 35 U.S.C. 154(b) by 97 days.

(21) Appl. No.: 10/002,080

(22) Filed: Oct. 31, 2001

(65) Prior Publication Data

US 2003/0079826 A1 May 1, 2003

(51) Int. Cl.[7] ..... B31F 1/28
(52) U.S. Cl. ..... 156/210; 156/472
(58) Field of Search ..... 156/205, 206, 156/207, 208, 210, 462, 470, 471, 472; B31F 1/28

(56) References Cited

U.S. PATENT DOCUMENTS 3,604,087 A 9/1971 Beck
3,919,029 A * 11/1975 Osgood ..... 156/205
4,136,546 A * 1/1979 Lehmann ..... 72/241.6
5,092,180 A 3/1992 Knop
5,614,048 A * 3/1997 Barny et al. ..... 156/205
5,846,173 A 12/1998 Grabscheid et al.
6,073,548 A * 6/2000 Kayser et al. ..... 100/35
6,149,751 A * 11/2000 Marschke ..... 156/205
6,155,319 A 12/2000 Giugliano et al.
6,476,151 B1 * 11/2002 Araki et al. ..... 525/276
6,602,375 B2 * 8/2003 Marschke ..... 156/205
2003/0075263 A1 * 4/2003 Marschke ..... 156/210

FOREIGN PATENT DOCUMENTS

GB 2308392 A * 6/1997 ..... B31F/1/28
WO WO 97/26132 7/1997

* cited by examiner

*Primary Examiner*—Gladys JP Corcoran
(74) *Attorney, Agent, or Firm*—Andrus, Sceales, Starke & Sawall, LLP

(57) ABSTRACT

A soft contact roll is mounted immediately downstream of the generator roll in a single facer to press the freshly glued single face web against the surface of the heated fluted bonding roll with a light load uniformly distributed across the full width of the web. The contact roll helps spread the adhesive more quickly and uniformly.

12 Claims, 4 Drawing Sheets

SOFT CONTACT ROLL FOR A SINGLE FACER

BACKGROUND OF THE INVENTION

The present invention relates to a single facer for the production of a single face corrugated paperboard web and, more particularly, to an auxiliary soft contact roll mounted immediately downstream of the line of joining the liner web with the glued corrugated medium web on the corrugated bonding roll to enhance the quality of the glue bond.

Recent development in single facers for the production of single face corrugated web include the elimination of a high load pressure roll for providing an initial adhesive bond and instead using a large diameter heated corrugating roll on which the single face web is retained after joinder of the component webs to provide an initial green bond in the glue lines before the single face web leaves the bonding roll. It was discovered that the relatively high impact pressure roll in a prior single facer provided an initial mechanical bond, but tended to squeeze the starch adhesive from the flute tips so that a less than satisfactory final bond resulted. Furthermore, the freshly formed single face web was removed from the corrugating roll before an adequate green bond was formed and also subjected to flexing movement which could disrupt the glue lines before an adequate bond was formed.

In an improved single facer construction, the freshly glued single face web was retained on and wrapped around a significant portion of a large diameter fluted and heated bonding roll, on which the medium web was also corrugated, so that an adequate green bond could be formed in the glue lines before the single face web was removed from the bonding roll. An apparatus of this type is shown, for example, in U.S. Pat. No. 6,149,751, the disclosure of which is incorporated by reference herein. In such an improved single facer, web tension alone was found to provide adequate force to hold the component webs together on the bonding roll while adhesive green bonds formed.

In some cases, however, it was found that the web tension by which the freshly glued single face web was wrapped on the fluted bonding roll did not provide a sufficient force to adequately hold the liner web in contact with the glued flute tips of the corrugated medium web and to spread the glue for an optimum bond. It has been found to be important to press and spread the freshly applied glue lines between the medium flute tips and the liner before gelatinization of the starch adhesive to assure uniform and optimum penetration of adhesive into the fibers of both webs. Once the adhesive has gelled, it becomes more difficult to spread and does not penetrate the paper as well. The present invention, therefore, provides an apparatus and method for enhancing the bond in a freshly glued single face web by providing an auxiliary pressure radially against the single face web on the bonding roll.

SUMMARY OF THE INVENTION

In accordance with the present invention, an auxiliary contact roll is mounted downstream of the line of initial tangent contact between the liner web and the glued corrugated medium web to press the single face web against the bonding roll with a relatively light radial force distributed uniformly across the width of the single face web. The contact roll is mounted with its axis of rotation parallel to the rotational axis of the bonding roll and is mounted directly adjacent the means by which the liner web is brought into contact with the glued corrugated medium web, typically a generator roll around which the liner is delivered and brought into tangent contact with the medium web without nipping contact. The outer surface of the contact roll is provided with a relatively soft rubber cover or coating to protect the bonding roll from damaging contact when no web is present and to accommodate slight misalignments during operation.

The contact roll includes a roll end support mechanism that is operative to vary the position of the contact roll radially with respect to the bonding roll and to vary the loading of the contact roll against the single face web. In the preferred embodiment, the contact roll comprises a center dead shaft including stub shaft ends connected to the end support mechanism, and an outer shell that is rotatably supported on the dead shaft by a plurality of axially spaced bearings.

The support mechanism for the contact roll comprises an eccentric coupling fixed at one end to each of the stub shaft ends, each coupling providing a connection to a pivot shaft at its other end, each pivot shaft in turn journaled for limited rotation on a pivot axis parallel to the axis of the dead shaft, and an actuator connected to each pivot shaft and operative to provide the limited rotation of the pivot shaft to vary the position of the contact roll with respect to the bonding roll and the single face web wrapped thereon. In the preferred embodiment, the actuators comprise pneumatic cylinders, each having a cylinder rod end connected eccentrically to one of the pivot shafts.

The contact roll dead shaft preferably includes a larger diameter axial center portion that joins reduced diameter opposite end portions, and the outer shell has an axial center portion with a larger wall thickness joining opposite shell end portions of reduced wall thickness. Preferably, the axial center portions of the dead shaft and the outer shell are approximately equal in length. The outer shell is preferably rotatably supported by a pair of bearings positioned adjacent the ends of the axial center portions of the outer shell and the dead shaft.

The method of the present invention includes the steps of (1) positioning a rotatable contact roll on an axis of rotation parallel to the axis of rotation of the bonding roll and closely adjacent and downstream of the generator roll, (2) mounting the contact roll for movement radially with respect to the bonding roll into contact with the single face web on the bonding roll, and (3) loading the contact roll against the single face web with a force uniformly distributed across the width of the web. Preferably, the loading step provides a force of about 5 pounds per lineal inch of web width.

The glue preferably comprises a starch adhesive and the method includes the step of heating the bonding roll. In accordance with the preferred method, the contact roll is provided with a coating of a rubber-like material.

DETAILED DESCRIPTION OF THE PREFERRED EMBODIMENT

Figure 1:
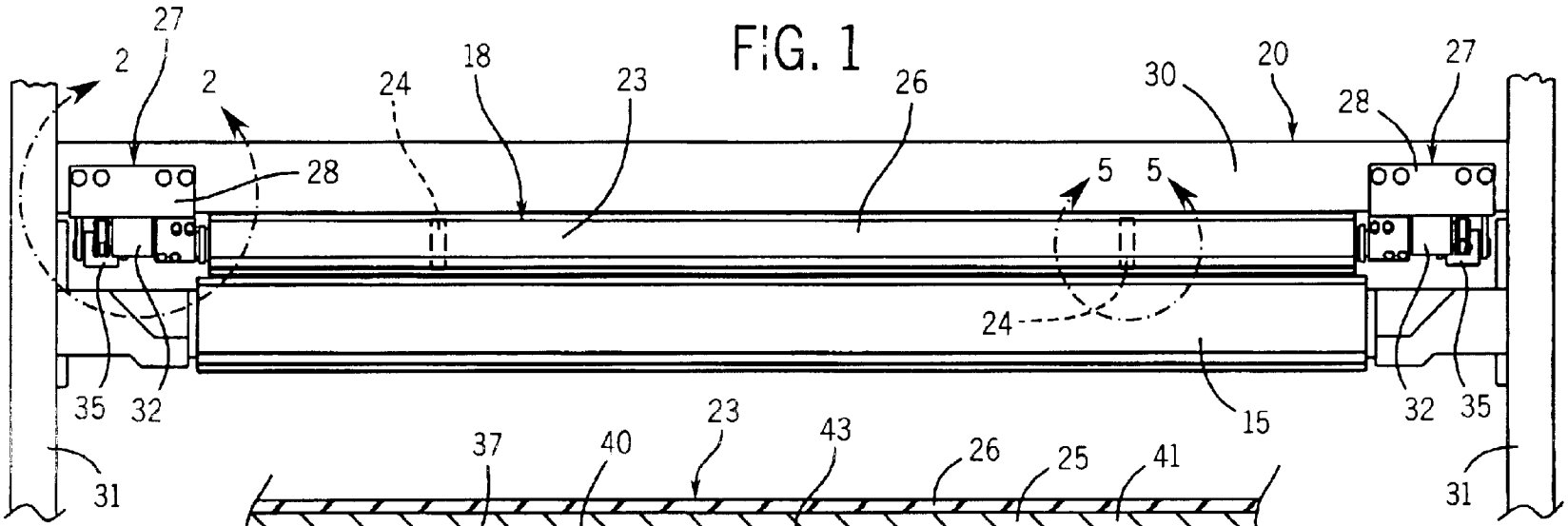
FIG. 1 is a front elevation view of the apparatus of the present invention.
Figure 5:
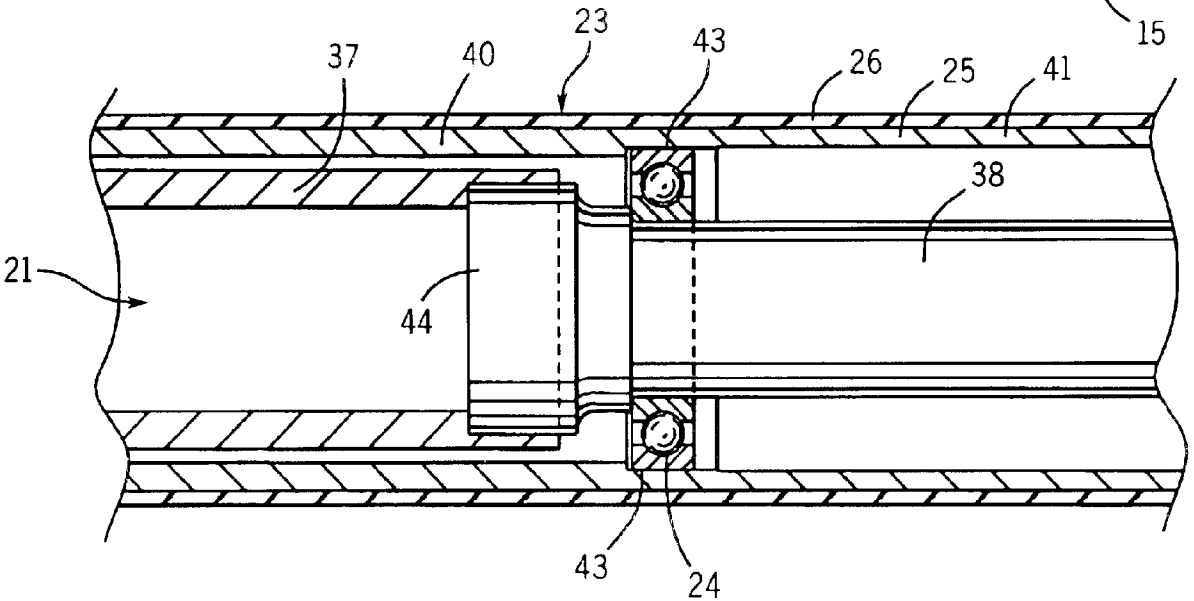
FIG. 5 is an enlarged sectional detail taken on line 8—8 of FIG. 1.
Figure 4:
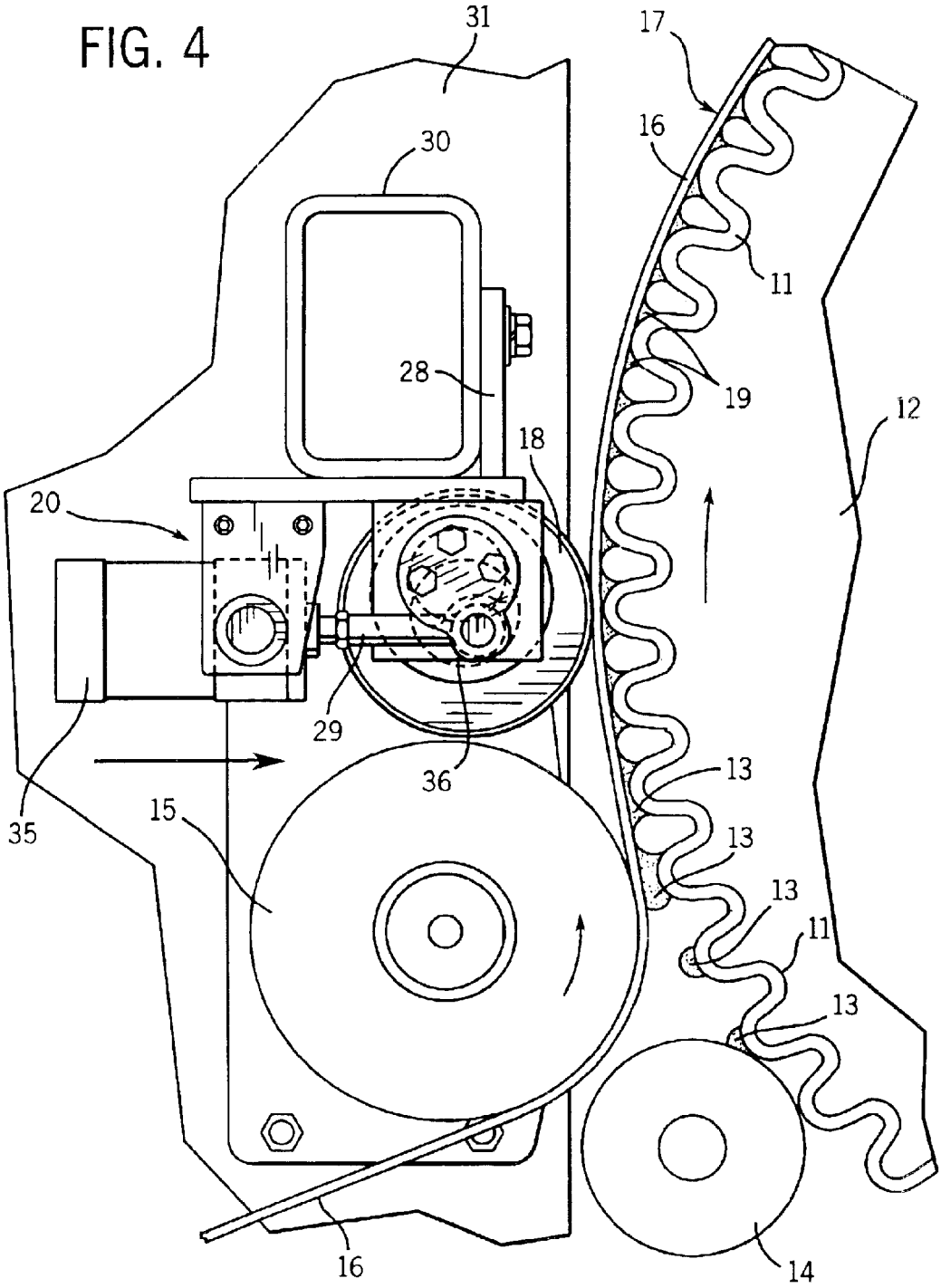
FIG. 4 is an end elevation similar to FIG. 3 showing the contact roll in the operative position and with glue applied to the web.

Referring to FIGS. 1 and 4, there is shown a portion of a single facer 10 similar in construction to the apparatus disclosed in above identified U.S. Pat. No. 6,149,715. A medium web 11 is delivered to the single facer from an upstream source and is corrugated in the nip formed by a large diameter corrugating roll 12 (hereinafter sometimes referred to as the bonding roll) and a small diameter lower corrugating roll (not shown). Immediately downstream of the corrugating nip, a glue machine applies a starch adhesive from a glue roll 14 to the flute tips of the corrugated medium web 11 on the large diameter corrugating roll 12. The adhesive is applied as glue lines 13 that form beads extending continuously across the full width of the corrugated medium web 11 (see FIG. 4). Immediately downstream from the glue roll 14, a delivery roll or generator roll 15 brings a liner web 16 from an upstream source into tangent contact with the glued flute tips of the medium web 11 on the large diameter roll 12 to form a freshly glued single face web 17. In order to form a good bond between the medium web 11 and the liner web 16, the starch adhesive must be heated and dehydrated. The mechanism by which a starch base adhesive dries and cures includes initial gelatinization at a temperature of about 150° F. (65° C.), followed by entry into a green bond stage at further elevated temperature beginning at about 200° F. (93° C.).

As described in the above identified patent, the large diameter corrugating roll 12 is preferably internally heated, as with steam, to a temperature sufficient to heat the web and the starch adhesive to the green bond temperature. The large diameter bonding roll 12 provides a circumferential length downstream from the generator roll 15 on which the freshly glued single face web 17 may be held until adhesive green bond strength has been attained. The primary force holding the liner web 16 into contact with the glued flute tips of the medium web 11 is provided by tension in the liner web 16 between the generator roll 15 and a downstream takeoff roll (not shown) where the single face web leaves the bonding roll 12. It has been found, however, that in certain cases depending on paper type and caliper and flute size, the force by which the liner web 16 is pressed against the glued flute tips of the corrugated medium web 11 could be increased slightly and the resulting bond enhanced. The beaded glue lines 13 should be spread uniformly across the full width of the web and this uniform spreading should take place before initial gelatinization of the starch. If the starch is allowed to gelatinize before spreading, not only is the adhesive difficult to spread, but it will not penetrate into the paper webs as well.

Thus, in accordance with the present invention, a soft surface contact roll 18 is positioned just downstream from the generator roll 15 and mounted to be moved radially and with an adjustable force into contact with the freshly glued single face web 17 on the bonding roll 12. The soft contact roll 18 is positioned very close to and downstream of the generator roll 15 so that it can assist in uniformly spreading the glue lines 13 before gelatinization of the starch occurs on the heated bonding roll 12. The progression of spreading of the glue lines 13 is shown in FIG. 4 where the freshly placed beads on the flute tips of the corrugated medium web 11 are progressively spread as contact is made by the liner web 16. The contact roll 18 assures that the final glue fillets 19 on opposite sides of the flute tips are formed rapidly and before gelatinization. The contact roll 18 is supported with a roll support mechanism 20 that rotatably carries the roll by its opposite ends and is operative to vary the position of the roll radially with respect to the bonding roll 12. The contact roll itself includes a unique construction that assures a more uniform load applied across the full width of the single face web.

Figure 2:
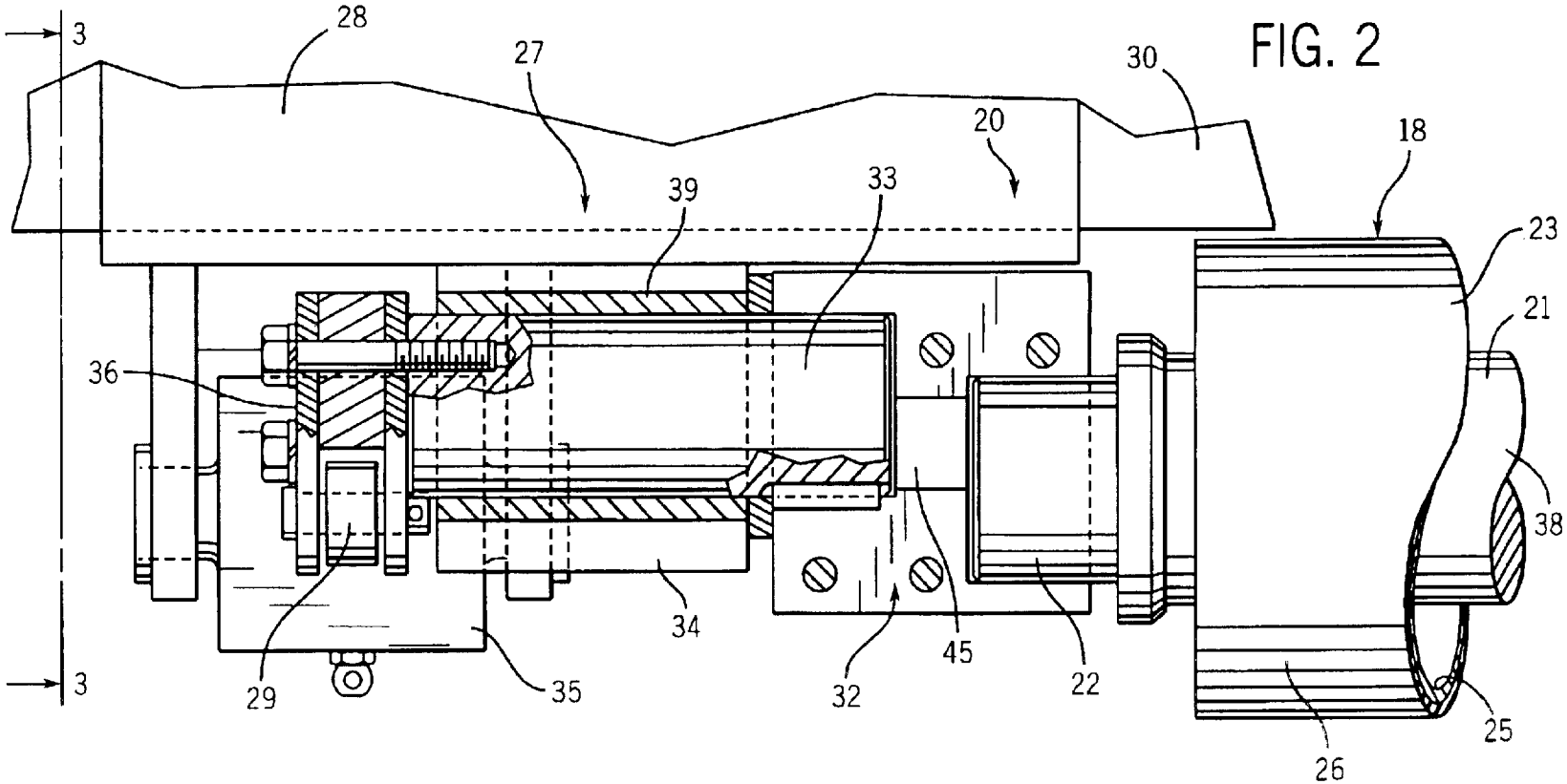
FIG. 2 is an enlarged detail, partly in section, of the roll support mechanism on one end of the contact roll taken generally on line 2—2 of FIG. 1.
Figure 3:
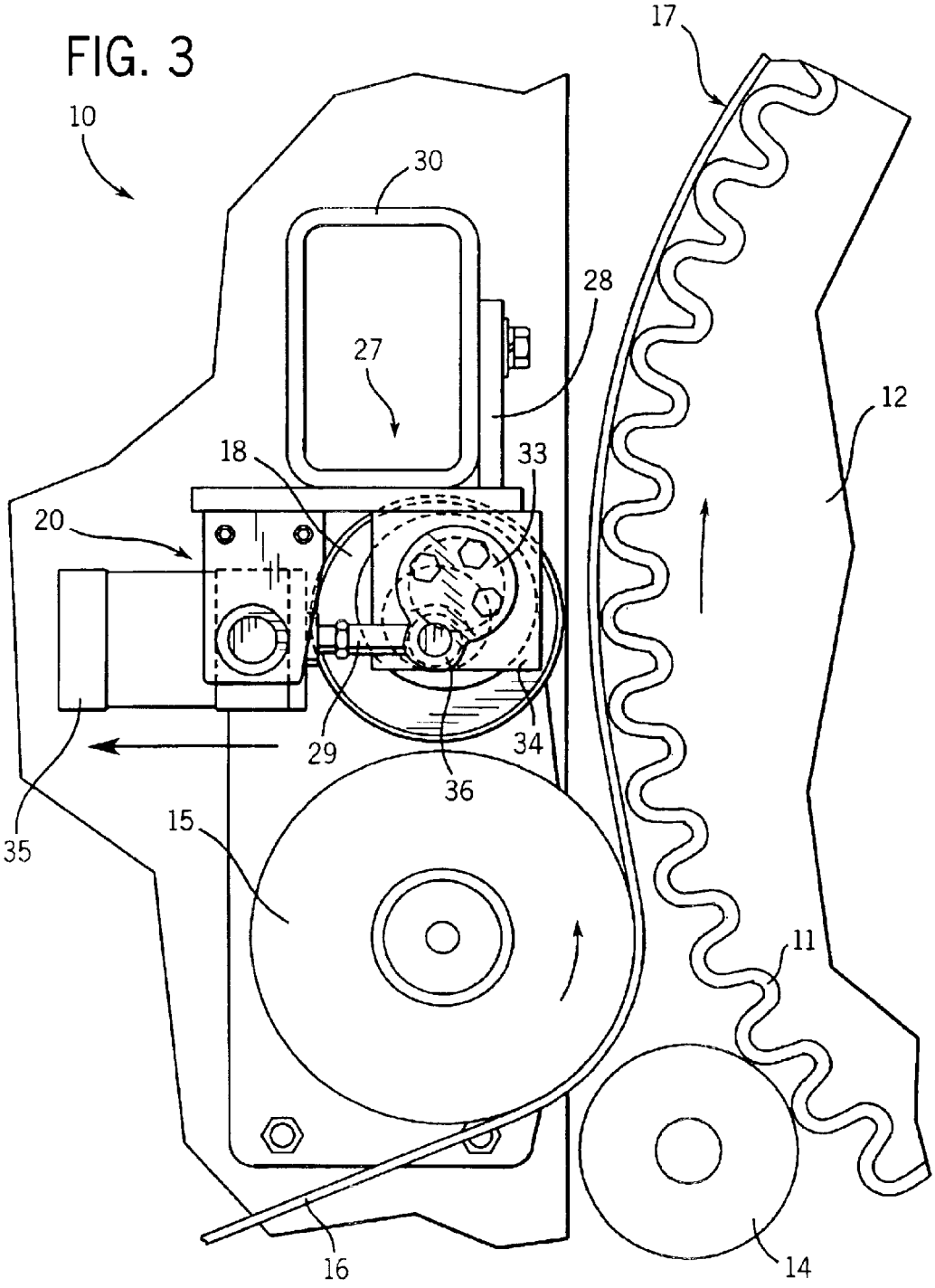
FIG. 3 is an enlarged end elevation view taken on line 3—3 of FIG. 2 of the roll support mechanism shown in the retracted inoperative position.

Referring also to FIGS. 2 and 3, the contact roll 18 includes a center dead shaft 21 that has opposite stub shaft ends 22 which are connected to the roll support mechanism 20. An outer roll shell 23 is rotatably supported on the dead shaft by two axially spaced bearings 24 which are uniquely and strategically positioned, as will be described. The outer roll shell 23 includes a steel inner liner 25 covered by an outer cover of a soft rubber-like material. One particularly suitable material for the outer cover 26 is an EPDM material having a thickness of about 0.2 inch (about 5 mm) having a 70 durometer.

The contact roll support mechanism 20 includes identical mirror-image support sub-assemblies 27 attached to opposite ends of the dead shaft stub ends 22. Each support subassembly 27 is carried on a mounting bracket 28 which, in turn, is attached to a cross frame member 30. The ends of the cross frame member 30 are attached to opposite machine side frame members 31. The side frame members 31 also carry the ends of the generator roll 15 which, as shown in FIG. 1, is mounted directly below the contact roll 18 of the present invention.

Each roll support sub-assembly 27 has an eccentric coupling 32 that includes an eccentric connector 45 fixed off-center to a stub shaft end 22 and further connected eccentrically to the end of a short pivot shaft 33. The pivot shaft is journaled for limited rotational movement in a bushing 39 mounted on a pivot shaft support 34. The pivot shafts 33 are axially aligned and their axis is parallel to the axis of the contact roll dead shaft 21. The pivot shaft supports are secured to the mounting brackets 28 for the respective support sub-assemblies 27. On the opposite axial outer end of each pivot shaft 33, the rod end 29 of a pneumatic cylinder 35 is eccentrically connected via a clevis 36. The cylinder 35 is secured to the sub-assembly mounting bracket 28. In FIG. 3, the cylinder 35 is shown with the cylinder rod 29 retracted and the rubber covered surface of the contact roll 18 spaced from the single face web 17 on the bonding roll 12 by a distance of about ½ inch (about 12.5 mm). When the cylinders 35 of the two sub-assemblies 27 are extended simultaneously, the pivot shafts 33 are rotated through a small acute angle and the eccentric coupling arrangement causes the dead shaft 21 and the roll shell 23 journaled thereon to move generally radially with respect to the bonding roll 12 and into contact with the single face web 17 which is carried on the bonding roll, as shown in FIG. 4.

The cylinders 35 are preferably operated to cause the contact roll 18 to rotatably bear against the single face web with a force sufficient to provide a load of about 5 lbs. per lineal inch across the full width of the web. This low load contact has been found to spread the glue lines 13 uniformly and rapidly and to significantly improve the bond between the liner and medium webs.

The contact roll 18 is specially constructed to resist deflection and to assure that the load applied to the single face web is uniform across the full width of the web. The axial center portion of the dead shaft 21 has a larger diameter than its end portion. Similarly, the center portion of the roll shell 23 is of a heavier construction than the respective opposite end portions. Specifically, the dead shaft 21 includes a larger diameter tubular center portion 37 that joins reduced diameter solid end shaft portions 38. The connection between the tubular center portion 37 and the opposite end shaft portions 38 comprises a hub 44 on the axial inner end of each end shaft portion that is seated and fixed (as by welding) in a counterbore in the end of the tubular center portion 37. The inner steel sleeve 25 of the roll shell 23 has an axial center portion 40 having a greater wall thickness than the opposite end portions 41 of the sleeve.

The roll shell 23 is journaled to rotate on the dead shaft 21 with a pair of axially spaced bearings 24. The larger diameter center portion 37 of the dead shaft 21 and the thicker center portion 40 of the roll sleeve 25 are preferably of approximately the same axial length. The bearings 24 are mounted with the inner bearing races on the reduced diameter portions 38 of the dead shaft immediately adjacent the hubs 44. Similarly, the outer races of the bearings 42 abut a shoulder 43 defining the transition between the thicker center portion 40 and the adjoining end portions 41 of the roll sleeve 25.

We claim:

1. An apparatus for forming a single face corrugated paperboard web from a liner web and a corrugated medium web, the medium web being corrugated on a heated fluted bonding roll and having starch based adhesive glue lines applied to the flute tips while said medium web remains on said bonding roll, a generator roll for bringing the liner web into initial tangent contact with the glue lines on the flute tips of the corrugated medium on the bonding roll without nipping contact to form a composite single face web on said bonding roll, the improvement comprising:

a contact roll having an axis of rotation parallel to the rotational axis of the bonding roll and mounted closely spaced from and immediately downstream of the generator roll to lightly press the single face web against the bonding roll with a radial force distributed uniformly across the width of the single face web to spread the adhesive glue lines between the flute tips and the liner before gelatinization of the adhesive.

2. The apparatus as set forth in claim 1 including a contact roll end support mechanism operative to vary the position of the contact roll radially with respect to the bonding roll.

3. The apparatus as set forth in claim 2 wherein the contact roll comprises:

a center dead shaft including stub shaft ends connected to said end support mechanism; and, an outer shell rotatably supported on said dead shaft by a plurality of axially spaced bearings.

4. The apparatus as set forth in claim 3 wherein said roll outer shell comprises a steel inner liner and a rubber outer cover.

5. The apparatus as set forth in claim 3 wherein said support mechanism comprises:

an eccentric coupling fixed to each stub shaft end, each coupling providing connection to a pivot shaft journaled for limited rotation on a pivot axis parallel to the axis of the dead shaft; and, an actuator connected to each pivot shaft and operative to provide the limited rotation thereto to vary the position of the contact roll.

6. The apparatus as set forth in claim 5 wherein each actuator comprises a pneumatic cylinder having a cylinder rod end connected eccentrically to one of the pivot shafts.

7. The apparatus as set forth in claim 3 wherein the dead shaft includes a larger diameter axial center portion joining reduced diameter opposite end portions; and, the outer shell having an axial center portion having a greater wall thickness joining opposite shell end portions of reduced wall thickness.

8. The apparatus as set forth in claim 7 wherein the axial center portion of said dead shaft and said outer shell are approximately equal in axial length.

9. The apparatus as set forth in claim 8 wherein the outer shell is rotatably supported by a pair of bearings positioned adjacent the ends of the axial center portion of the outer shell and the dead shaft.

10. In a single facer apparatus for forming a single face corrugated paperboard web from a liner web and a corrugated medium web, said apparatus including a fluted bonding roll on which the medium web is corrugated, a glue applicator that applies an adhesive to the flute tips of the corrugated medium web while the medium web is on the bonding roll, and a generator roll that brings the liner web into initial tangent contact with the glued flute tips of the corrugated medium web on the bonding roll without nipping contact to form the single face web, a method for enhancing the glue bond between the medium web and the liner web comprising the steps of:

(1) positioning a rotatable contact roll on a rotational axis parallel to the axis of rotation of the bonding roll closely adjacent and downstream of the generator roll;

(2) mounting said contact roll for movement radially with respect to the bonding roll into contact with the single face web on the bonding roll; and, (3) loading said contact roll against the single face web with a force uniformly distributed across the width of said web sufficient to spread the adhesive between the flute tips and the liner before gelatinization of the adhesive.

11. The method as set forth in claim 10 wherein said loading provides a force of about 5 pounds per lineal inch of web width.

12. The method as set forth in claim 10 including the step of providing said contact roll with a coating of a rubber-like material.

* * * * *